US009444205B2

(12) United States Patent
Rangi et al.

(10) Patent No.: US 9,444,205 B2
(45) Date of Patent: Sep. 13, 2016

(54) ELECTRIC CONNECTOR WITH CONTACT PROTECTION

(71) Applicant: Lear Corporation, Southfield, MI (US)

(72) Inventors: Bhupinder Rangi, Novi, MI (US); Michael Glick, Farmington Hills, MI (US); David Menzies, Linden, MI (US)

(73) Assignee: LEAR CORPORATION, Southfield, MI (US)

( * ) Notice: Subject to any disclaimer, the term of this patent is extended or adjusted under 35 U.S.C. 154(b) by 0 days.

(21) Appl. No.: 14/613,861

(22) Filed: Feb. 4, 2015

(65) Prior Publication Data

US 2015/0280381 A1 Oct. 1, 2015

Related U.S. Application Data

(60) Provisional application No. 61/970,134, filed on Mar. 25, 2014.

(51) Int. Cl.

| | |
|---|---|
| ***H01R 13/187*** | (2006.01) |
| ***H01R 24/86*** | (2011.01) |
| ***H01R 13/658*** | (2011.01) |
| ***H01R 13/18*** | (2006.01) |
| ***H01R 13/44*** | (2006.01) |

(52) U.S. Cl.

CPC ..... *H01R 24/86* (2013.01); *H01R 13/18* (2013.01); *H01R 13/44* (2013.01); *H01R 13/658* (2013.01)

(58) Field of Classification Search

CPC .... H01R 24/545; H01R 9/05; H01R 13/567; H01R 24/38; H01R 43/20; H01R 13/6277; H01R 13/187; H01R 13/18; H01R 13/111

See application file for complete search history.

(56) References Cited

U.S. PATENT DOCUMENTS

| | | | | |
|---|---|---|---|---|
| 3,716,817 | A * | 2/1973 | Wolfe, Jr. | H01R 13/20 439/346 |
| 4,040,713 | A | 8/1977 | Könnemann | |
| 4,540,234 | A | 9/1985 | Könnemann et al. | |
| 4,540,235 | A | 9/1985 | Lolic | |
| 4,583,812 | A | 4/1986 | Gross, Jr. et al. | |
| 4,932,877 | A | 6/1990 | Zinn | |
| 5,007,865 | A | 4/1991 | Jakobeit | |
| 5,064,379 | A | 11/1991 | Ryll et al. | |
| 5,080,604 | A | 1/1992 | Rider et al. | |
| 5,147,230 | A | 9/1992 | Plyler et al. | |

(Continued)

FOREIGN PATENT DOCUMENTS

| | | | |
|---|---|---|---|
| CN | 202094365 | U | 12/2011 |
| CN | 103996918 | A | 8/2014 |

(Continued)

OTHER PUBLICATIONS

PCT International Search Report and the Written Opinion, Application No. PCT/US2013/065900 filed Oct. 21, 2013, dated Feb. 12, 2014.

*Primary Examiner* — Xuong Chung Trans

(74) *Attorney, Agent, or Firm* — MacMillan, Sobanski & Todd, LLC

(57) ABSTRACT

An electric connector includes a connector body and a conductor base attached to the connector body. A plurality of contact arms extend from the conductor base away from the connector body and are located around a central space. The electric connector also includes a pin attached to the connector body and located in the central space.

20 Claims, 5 Drawing Sheets

(56) References Cited

U.S. PATENT DOCUMENTS

| | | | | |
|---|---|---|---|---|
| 5,334,058 | A | 8/1994 | Hotea | |
| 5,413,506 | A | 5/1995 | Thompson | |
| 5,415,571 | A | 5/1995 | Lutsch | |
| 5,437,566 | A | 8/1995 | Zinn et al. | |
| 5,486,123 | A * | 1/1996 | Miyazaki | H01R 13/15 439/825 |
| 5,558,547 | A | 9/1996 | Breitschaft et al. | |
| 5,573,434 | A | 11/1996 | Ittah et al. | |
| 5,616,717 | A | 4/1997 | Grozinger | |
| 5,654,972 | A | 8/1997 | Kuroiwa et al. | |
| 5,664,972 | A | 9/1997 | Zinn et al. | |
| 5,755,599 | A | 5/1998 | Hotea | |
| 5,868,590 | A | 2/1999 | Dobbelaere | |
| 5,938,486 | A * | 8/1999 | Durand-Cochet | H01R 13/18 439/745 |
| 5,941,740 | A | 8/1999 | Neuer et al. | |
| 5,975,964 | A | 11/1999 | Seko et al. | |
| 5,993,253 | A | 11/1999 | Sai | |
| 6,113,436 | A * | 9/2000 | Kuwahara | H01R 13/44 439/693 |
| 6,146,211 | A * | 11/2000 | Okamoto | H01R 13/04 439/181 |
| 6,224,428 | B1 | 5/2001 | Chen et al. | |
| 6,402,571 | B1 | 6/2002 | Muller et al. | |
| 6,475,040 | B1 | 11/2002 | Myer et al. | |
| 7,252,559 | B1 | 8/2007 | Morello et al. | |
| 7,278,891 | B2 | 10/2007 | Cvasa et al. | |
| 7,556,542 | B2 | 7/2009 | Lischeck et al. | |
| 7,578,694 | B2 | 8/2009 | Takahashi et al. | |
| 7,766,706 | B2 | 8/2010 | Kawamura et al. | |
| 7,892,050 | B2 | 2/2011 | Pavlovic et al. | |
| 7,988,481 | B2 | 8/2011 | Bethurum et al. | |
| 8,057,261 | B1 | 11/2011 | DeSio et al. | |
| 8,282,426 | B2 | 10/2012 | Zweigle | |
| 8,339,235 | B2 | 12/2012 | Beckert et al. | |
| 8,366,497 | B2 | 2/2013 | Glick et al. | |
| 8,475,220 | B2 | 7/2013 | Glick et al. | |
| 8,597,062 | B2 * | 12/2013 | Casses | H01R 4/184 439/686 |
| 8,678,867 | B2 | 3/2014 | Glick et al. | |
| 2001/0019924 | A1 | 9/2001 | Heimueller | |
| 2003/0067242 | A1 | 4/2003 | Konishi et al. | |
| 2006/0040555 | A1 | 2/2006 | Chen et al. | |
| 2010/0311280 | A1 | 12/2010 | Tin et al. | |
| 2012/0129407 | A1 | 5/2012 | Glick et al. | |
| 2013/0045630 | A1 | 2/2013 | Natter | |
| 2013/0090009 | A1 | 4/2013 | Zhao | |
| 2013/0130530 | A1 | 5/2013 | Casses et al. | |
| 2013/0330968 | A1 | 12/2013 | Duan | |
| 2014/0235113 | A1 | 8/2014 | Glick et al. | |

FOREIGN PATENT DOCUMENTS

| | | | |
|---|---|---|---|
| DE | 10019241 | A1 | 10/2001 |
| DE | 69934065 | T2 | 6/2007 |
| DE | 10021972 | B4 | 3/2009 |
| DE | 19961544 | B4 | 3/2009 |
| EP | 0282624 | A2 | 9/1988 |
| GB | 2323221 | A | 9/1998 |
| JP | 10125378 | A | 5/1998 |
| JP | 2011238399 | A | 11/2011 |
| WO | 89/05531 | A1 | 6/1989 |
| WO | 2014/063142 | A1 | 4/2014 |

* cited by examiner

ELECTRIC CONNECTOR WITH CONTACT PROTECTION

CROSS-REFERENCE TO RELATED APPLICATIONS

This application claims the benefit of U.S. Provisional Application No. 61/970,134, filed Mar. 25, 2014, the disclosure of which is incorporated herein by reference.

BACKGROUND OF THE INVENTION

This invention relates in general to an electric terminal. More specifically, this invention relates to a female electric terminal with contact protection features.

Electric connectors are used in a variety of situations where it is desirable to have an electric connection between components. For example, electric connectors are used to complete electrical circuits between components in a power distribution box or to connect a wiring harness to an electrical device.

Electrical connectors typically include resilient, electrically conductive terminals that are adapted to engage a corresponding terminal. In some cases, it is desirable to prevent accidental contact with the terminals in order to prevent damage to the terminals and to avoid unintended grounding of electric current. It would be advantageous to have an improved type of terminal protection.

SUMMARY OF THE INVENTION

This invention relates to an electric connector. The electric connector includes a connector body and a conductor base attached to the connector body. A plurality of contact arms extends from the conductor base away from the connector body and around a central space. The electric connector also includes a pin attached to the connector body and located in the central space.

Other embodiments of this invention also include a terminal shield that is attached to a connector body and extends farther in the outward direction than the contact arms. The terminal shield substantially surrounds the conductor base and contact arms and defines a terminal opening that is aligned with the central space.

This invention also relates to an electric terminal assembly. The electric terminal assembly includes a conductor with a conductor base and a plurality of contact arms that extends from the conductor base in an outward direction. The contact arms are located around a central space. The electric terminal assembly further includes a pin with a blocking portion that is located within the central space.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
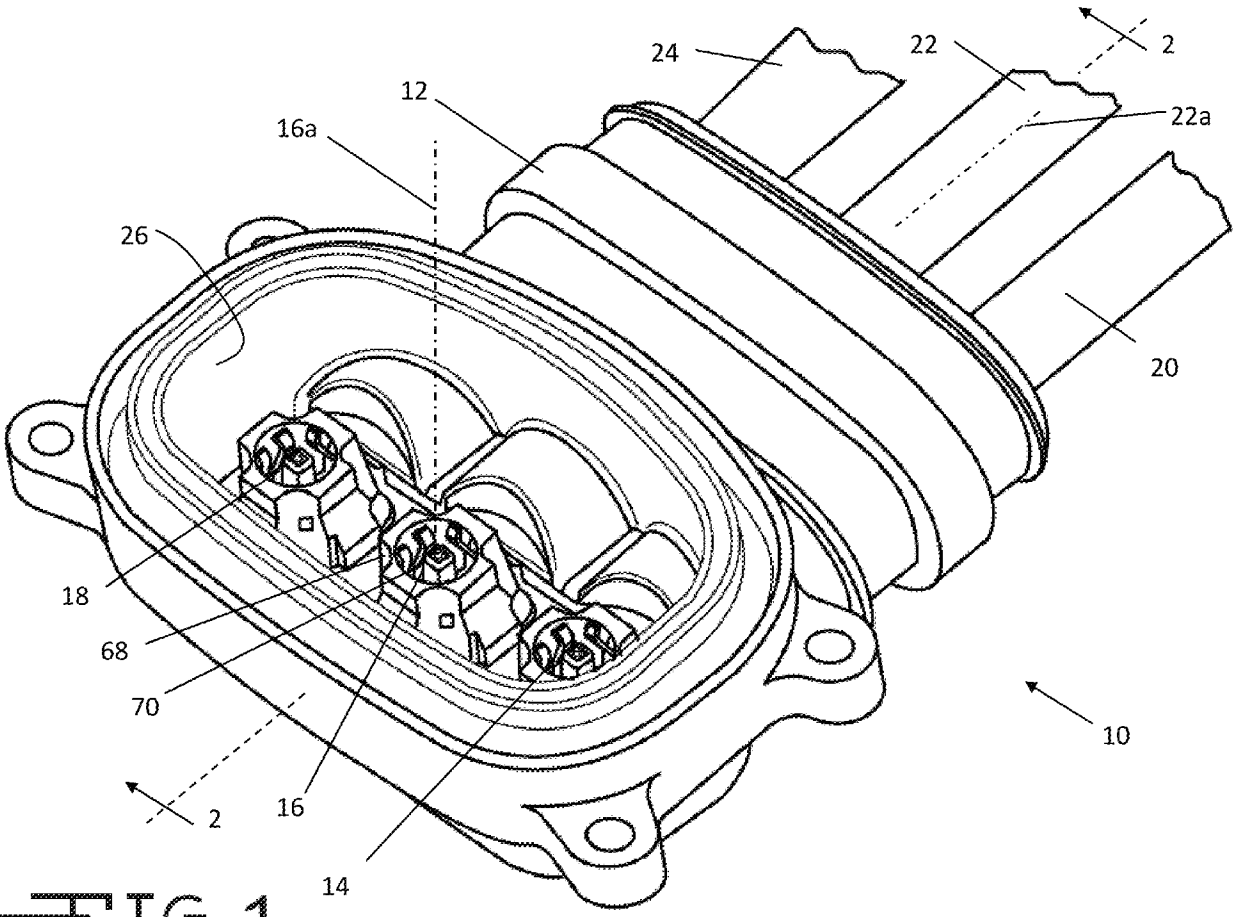
FIG. 1 is a perspective view of an electric connector.

Referring now to the drawings, there is illustrated in FIG. 1 a perspective view of an electric connector, indicated generally at 10. The electric connector 10 includes a connector body 12. The illustrated connector body 12 is made of aluminum, but may be made of any desired material. The illustrated electric connector 10 includes three electric terminal assemblies, indicated at 14, 16, and 18, that are connected to respective insulated wires 20, 22, and 24. However, the electric connector 10 may have any desired number of terminal assemblies and associated wires. The electric connector 10 includes a terminal retainer 26 that is attached to the connector body 12 in order to retain the electric terminal assemblies 14, 16, and 18 in place and to protect the electric terminal assemblies 14, 16, and 18. The illustrated terminal retainer 26 is made of electrically non-conductive plastic, but may be made of any desired material. Alternatively, the terminal retainer 26 may be formed integrally with the connector body 12, if desired.

Figure 2:
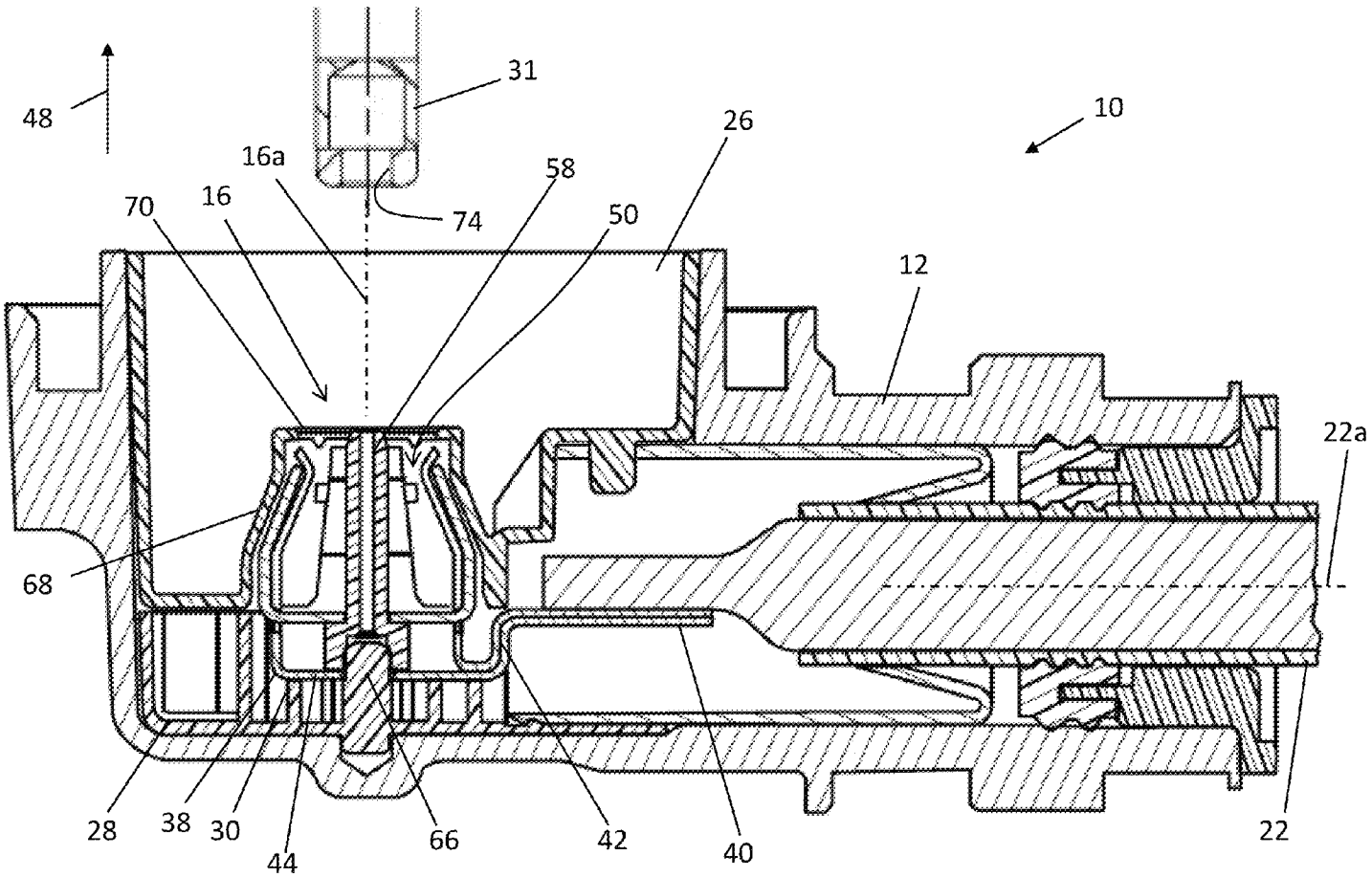
FIG. 2 is a cross-sectional view of the electrical connector taken along line 2-2 of FIG. 1.

As best shown in FIG. 2, the electric connector 10 includes a terminal interface 28 connected to the connector body 12. The terminal interface 28 may be held in place in the connector body 12 by a press fit or any desired fastener. The illustrated terminal interface 28 is made of electrically non-conductive plastic, but may be made of any desired material. The terminal interface 28 includes a cradle 30, and the electric terminal assembly 16 is mounted on the cradle 30. The cradle 30 serves to properly position the electric terminal assembly 16 relative to the connector body 12 when the electric connector 10 is assembled. It should be appreciated that the terminal interface 28 includes two other cradles (not shown) that the electric terminal assemblies 14 and 18 are respectively mounted on.

The illustrated electric terminal assembly 16 is a female-type terminal, but it should be appreciated that the electric terminal assemblies 14, 16, and 18 may be any desired type of terminal. Additionally, it should be appreciated that the electric connector 10 may include any desired number of electric terminal assemblies.

The electric terminal assembly 16 is adapted to engage a corresponding terminal 31 that can mate with the electric terminal assembly 16 by movement along a terminal axis 16*a*. The wire 22 connected to the electric terminal assembly 16 extends from the connector body 12 along a wire axis 22*a*. The terminal axis 16*a* and the wire axis 22*a* are substantially perpendicular and the illustrated electric connector 10 is a right-angle connector. However, the electric connector 10 may have any desired relative orientation between the terminal axis 16*a* and the wire axis 22*a*.

Figure 3:
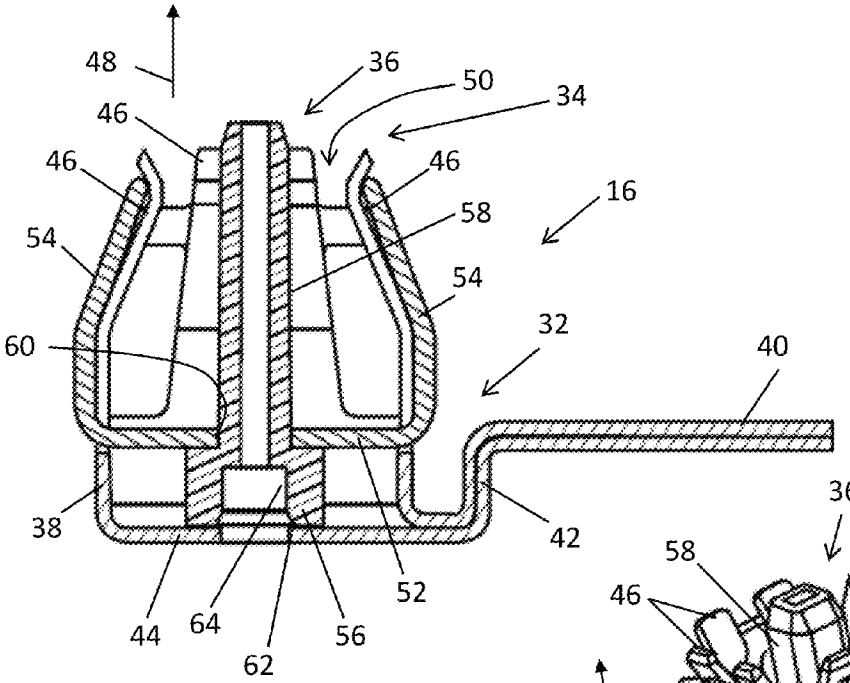
FIG. 3 is a cross-sectional view of an electric terminal assembly of the electrical connector shown in FIG. 2.
Figure 5:
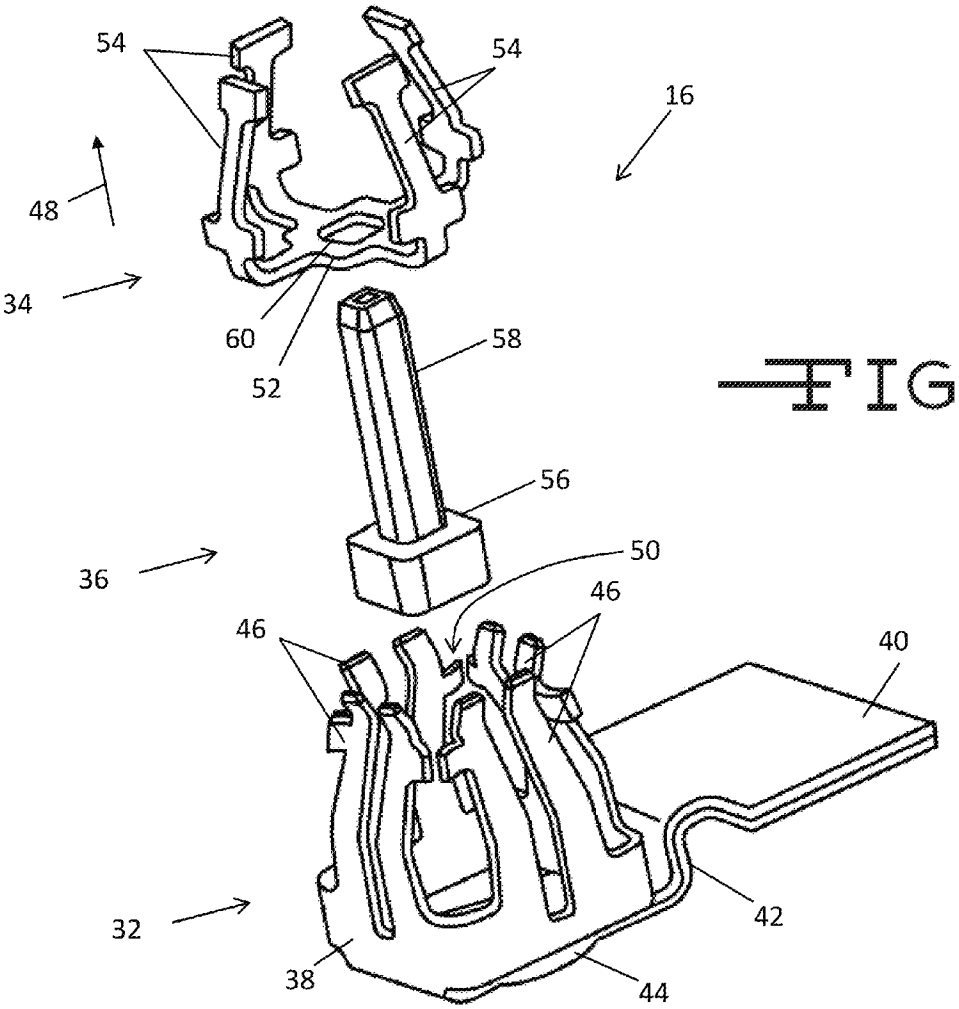
FIG. 5 is an exploded view of the electric terminal assembly shown in FIG. 4.

As best shown in FIG. 3 though FIG. 5, the electric terminal assembly 16 includes a conductor, indicated at 32, a spring, indicated at 34, and a pin, indicated at 36. The illustrated conductor 32 is made from folded sheet copper, but may be made of any desired material or process. The conductor 32 includes a conductor body 38 and a termination portion 40. As shown in FIG. 2, the wire 22 is connected to the electric terminal assembly 16 by being crimped to the termination portion 40. However, the wire 22 may be attached to the electric terminal assembly 16 by any desired fastener or method. The electric terminal assembly 16 includes a termination offset 42. The illustrated termination offset 42 is a bend located between the termination portion 40 and the conductor body 38 of the conductor 32. The termination offset 42 allows the wire 22 to be properly positioned relative to the connector body 12 when the electric connector 10 is assembled.

Figure 4:
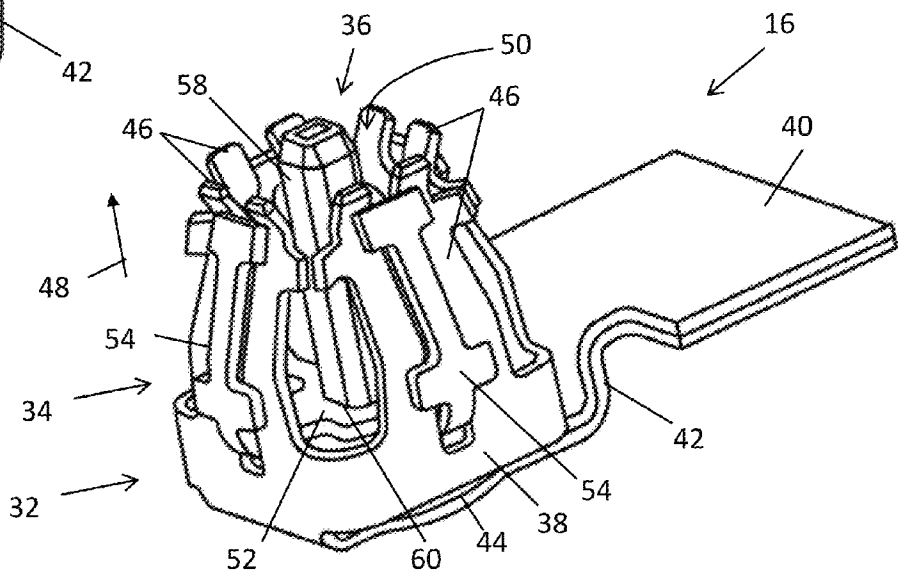
FIG. 4 is a perspective view of the electric terminal assembly shown in FIG. 3.

Referring back to FIGS. 3-5, the conductor body 38 includes a base 44 and a plurality of contact arms 46 that extend from the base 44 in an outward direction 48 away from the terminal interface 28. The contact arms 46 are adapted to engage the corresponding terminal 31. The contact arms 46 are located around a central space, indicated at 50.

The illustrated spring 34 is made from folded sheet stainless steel, but may be made of any desired material or process. The spring 34 includes a spring body 52 and a plurality of spring arms 54 that extend from the spring body 52 in the outward direction 48. The spring arms 54 are adapted to engage the contact arms 46 and bias them toward the central space 50. The spring 34 serves to increase the force with which the contact arms 46 engage the corresponding connector 31.

The illustrated pin 36 is made of electrically non-conductive plastic, but may be made of any desired material. The pin 36 includes a pin body 56 and a blocking portion 58 that extends from the pin body 56 in the outward direction 48. The illustrated blocking portion 58 has a substantially square cross-sectional shape with rounded corners, but the blocking portion 58 may have any desired shape. The pin 36 serves to protect the contact arms 46 from accidental contact, as will be described below.

The illustrated spring body 52 defines a pin opening 60. The illustrated pin opening 60 has substantially the same cross-sectional shape as the blocking portion 58 of the pin 36, but may have any desired shape that will accommodate the blocking portion 58. The blocking portion 58 of the pin 36 passes through the pin opening 60, and the pin body 56 is located between the spring body 52 and the base 44 of the conductor 32. The blocking portion 58 of the pin 36 is positioned within the central space 50, between the contact arms 46. As best seen in FIG. 3, the blocking portion extends farther in the outward direction 48 than the contact arms 46 do.

As also seen in FIG. 3, the base 44 of the conductor 32 defines a conductor mounting opening 62, and the pin body 56 defines a pin mounting opening 64. The conductor mounting opening 62 and the pin mounting opening 64 have substantially circular cross-sectional shapes, and are coaxially aligned with each other. However, the conductor mounting opening 62 and the pin mounting opening 64 may have any desired shapes.

Figure 6:
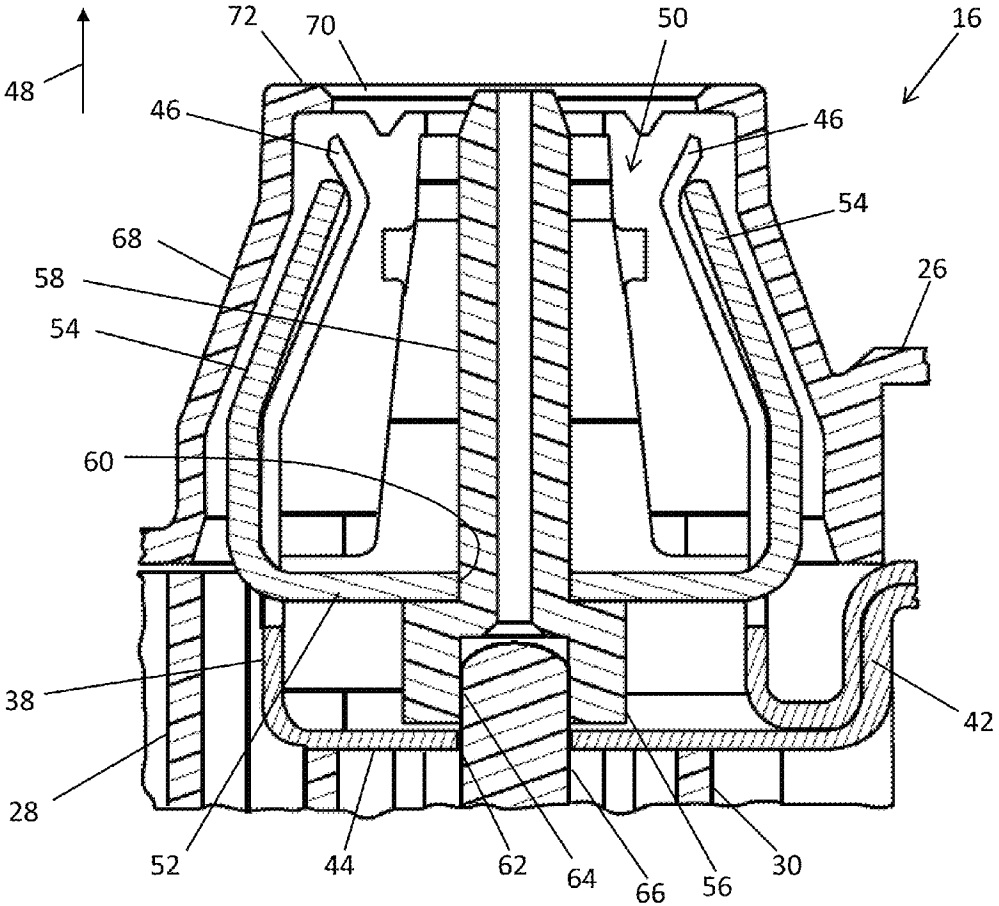
FIG. 6 is an enlarged view of a portion of the electric terminal assembly illustrated in FIG. 2.

As shown in FIG. 2 and FIG. 6, the terminal interface 28 includes a positioning post 66. The positioning post has substantially the same cross-sectional shape as the conductor mounting opening 62 and the pin mounting opening 64. When the electric terminal assembly 16 is mounted on the cradle 30, the positioning post 66 passes through the conductor mounting opening 62 and the pin mounting opening 64.

The terminal retainer 26 includes a terminal shield 68 that substantially surrounds the electric terminal assembly 16. The terminal shield 68 extends farther in the outward direction 48 than the contact arms 46. It should be appreciated that the connector body 12 and the terminal shield 68 substantially surround the electric terminal assembly 16 and provide protection against inadvertent contact causing damage to the electric terminal assembly 16. Further, it should be appreciated that the terminal shield 68 and terminal interface 28 are preferably made of electrically non-conductive plastic, which helps prevent inadvertent grounding of the electric terminal assembly 16. The terminal retainer 26 defines a terminal opening 70 that is aligned with the central space 50 and allows the corresponding terminal 31 to engage the contact arms 46 of the electric terminal assembly 16. As shown in FIG. 1, the illustrated terminal opening 70 has a substantially circular cross-sectional shape, but the terminal opening 70 may have any desired shape to accommodate the corresponding terminal 31.

Referring back to FIG. 6, the terminal shield 68 includes a radially extending portion 72. The radially extending portion 72 allows the terminal shield 68 to be located in-line with the contact arms 46 in the outward direction 48. This allows the terminal shield 68 to help prevent the contact arms 46 from being damaged if, for example, the corresponding terminal 31 were pushed onto the electric terminal assembly 16 without being properly aligned. The illustrated radially extending portion 72 is located on the terminal shield 68 farthest in the outward direction 48, and the radially extending portion 72 defines the terminal opening 70. However, the radially extending portion 72 may be provided on any other desired location on the terminal shield 68.

The illustrated blocking portion 58 of the pin 36 extends partially into the terminal opening 70. However, the blocking portion 58 may extend any desired distance in the outward direction 48 relative to the terminal opening 70. It should be appreciated that the blocking portion 58 helps to prevent inadvertent with the contact arms 46 by an object being inserted through the terminal opening 70. It should also be appreciated that if the electric terminal assembly 16 did not include the pin 36, then an object smaller than the terminal opening 70 could pass the terminal shield 68 and engage the contact arms 46. However, the pin 36 provides a limit on the size and shape of object that can pass through the terminal opening 70. For example, a solid object having the same diameter as the terminal opening 70 will be unable to pass through the illustrated terminal opening 70 as it would engage the blocking portion 58 of the pin 36.

Referring back to FIG. 2, the corresponding terminal 31 is adapted to be mated with the electric terminal assembly 16 by moving the corresponding terminal 31 along the terminal axis 16*a* in a direction opposite the outward direction 48 into the central space 50. The corresponding terminal 31 defines an internal space 74 with a cross-sectional shape that will accommodate the blocking portion 58 of the pin 36. When the corresponding terminal 31 is mated with the corresponding terminal 31, the blocking portion 58 will be located within the internal space 74.

It should be appreciated that the described electrical connector 10 includes features to prevent inadvertent contact with the contact arms 46, while not hindering the intentional engagement of the corresponding terminal 31 with the contact arms 46.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric connector comprising:

a connector body;

a conductor base attached to the connector body;

a plurality of contact arms that extends from the conductor base away from the connector body, the contact arms defining a central space;

a spring that includes a plurality of spring arms that engage the plurality of contact arms and bias the plurality of contact arms toward the central space, and a pin attached to the connector body and located in the central space.

2. The electric connector of claim 1, further comprising a terminal shield attached to the connector body that substantially surrounds the conductor base and contact arms.

3. The electric connector of claim 2, wherein the terminal shield defines a terminal opening that is aligned with the central space.

4. The electric connector of claim 3, wherein the pin extends into the terminal opening.

5. The electric connector of claim 2, wherein the plurality of contact arms extends from the conductor base in an outward direction, and the terminal shield extends farther in the outward direction than the plurality of contact arms.

6. The electric connector of claim 1, wherein the plurality of contact arms extends from the conductor base in an outward direction, and the pin extends farther in the outward direction than the plurality of contact arms.

7. The electric connector of claim 1, wherein the spring includes a spring body and the plurality of spring arms extends from the spring body, and wherein the spring body defines a pin opening that the pin passes through.

8. The electric connector of claim 7, wherein the pin includes a pin body that is located between the spring body and the conductor base.

9. The electric connector of claim 8, wherein the conductor base defines a conductor mounting opening and the pin body defines a pin mounting opening and the connector body includes a positioning post that is located in the conductor mounting opening and the pin mounting opening.

10. An electric connector comprising:

a connector body;

a conductor base attached to the connector body;

a plurality of contact arms that extends from the conductor base in an outward direction away from the connector body, the contact arms located around a central space;

a terminal shield attached to the connector body that extends farther in the outward direction than the contact arms and substantially surrounds the conductor base and contact arms, the terminal shield defining a terminal opening that is aligned with the central space; and a blocking portion located in the terminal opening, wherein the terminal shield and the blocking portion are made of an electrically non-conductive material.

11. The electric connector of claim 10, wherein the blocking portion is positioned within the central space.

12. An electric terminal assembly comprising:

a conductor that includes a conductor base and a plurality of contact arms that extends from the conductor base in an outward direction, the contact arms located around a central space;

a spring that includes a plurality of spring arms that engage the contact arms and bias the contact arms toward the central space; and a pin that includes a blocking portion that is located within the central space, wherein the spring includes a spring body and the plurality of spring arms extends from the spring body, and the spring body defines a pin opening that the blocking portion of the pin passes through.

13. The electric terminal assembly of claim 12, wherein the pin includes a pin body that is located between the spring body and the conductor base, and wherein the blocking portion of the pin extends in the outward direction from the pin body.

14. The electric terminal assembly of claim 13, wherein the conductor base defines a conductor mounting opening and the pin body defines a pin mounting opening that is aligned with the conductor mounting opening.

15. The electric terminal assembly of claim 12, wherein the blocking portion extends farther in the outward direction than the contact arms.

16. An electric connector comprising:

a connector body;

a conductor base attached to the connector body;

a plurality of contact arms that extends from the conductor base away from the connector body, the contact arms defining a central space; and a pin attached to the connector body and extending into the central space, wherein the pin is made of an electrically non-conductive material.

17. The electric connector of claim 16, further including a spring having a plurality of spring arms that engage the plurality of contact arms and bias the plurality of contact arms toward the central space.

18. The electric connector of claim 17, wherein the pin includes a pin body that is located between the spring and the conductor base.

19. The electric connector of claim 17, wherein the spring includes a spring body, the plurality of spring arms extends from the spring body, and the spring body defines a pin opening through which the pin passes.

20. The electric connector of claim 16, wherein the pin extends farther away from the connector body than the contact arms.

* * * * *